US007823512B2

(12) United States Patent
Timan et al.

(10) Patent No.: US 7,823,512 B2
(45) Date of Patent: Nov. 2, 2010

(54) MONORAIL BOGIE HAVING IMPROVED ROLL BEHAVIOR

(75) Inventors: Peter Edward Timan, Sydenham (CA); Friedrich Wilhelm Honegger, Hemmental (CH)

(73) Assignee: Bombardier Transportation GmbH, Berlin (DE)

( * ) Notice: Subject to any disclaimer, the term of this patent is extended or adjusted under 35 U.S.C. 154(b) by 96 days.

(21) Appl. No.: 12/149,149

(22) Filed: Apr. 28, 2008

(65) Prior Publication Data

US 2009/0266268 A1 Oct. 29, 2009

(51) Int. Cl.
*B61B 13/06* (2006.01)

(52) U.S. Cl. ..... 105/144; 105/145

(58) Field of Classification Search ..... 105/141, 105/144, 145
See application file for complete search history.

(56) References Cited

U.S. PATENT DOCUMENTS

| | | | | |
|---|---|---|---|---|
| 3,017,838 | A | 1/1962 | Bingham | |
| 3,143,977 | A | 8/1964 | Deller | |
| 3,216,371 | A | 11/1965 | Holmquist et al. | |
| 3,584,583 | A | 6/1971 | Cartwright | |
| 3,602,152 | A | 8/1971 | Hawes | |
| 4,133,268 | A * | 1/1979 | Guillaumin | 105/202 |
| 4,362,108 | A | 12/1982 | Jenkner | |
| 4,485,743 | A | 12/1984 | Roush et al. | |
| 4,825,774 | A | 5/1989 | Tani et al. | |
| 4,843,971 | A | 7/1989 | Braunagel | |
| 4,926,756 | A | 5/1990 | Smith et al. | |
| 4,953,472 | A | 9/1990 | Tutzer | |
| 4,996,928 | A * | 3/1991 | Janssen et al. | 105/144 |
| 6,523,481 | B2 | 2/2003 | Hara et al. | |
| 2005/0241525 | A1 | 11/2005 | Coakley | |

FOREIGN PATENT DOCUMENTS

| | | |
|---|---|---|
| CA | 654092 | 12/1962 |
| CA | 1327916 | 3/1994 |
| CA | 2337977 | 9/2001 |
| JP | 64-028066 | 1/1989 |
| JP | 01-078967 | 3/1989 |
| JP | 2000264198 | 3/1989 |
| JP | 02-070804 | 3/1990 |
| JP | 03-262713 | 11/1991 |

(Continued)

OTHER PUBLICATIONS

Office Action mailed on Aug. 6, 2010 in connection with U.S. Appl. No. 12/129,222, 6 pages.

*Primary Examiner*—S. Joseph Morano
*Assistant Examiner*—Zachary Kuhfuss

(57) ABSTRACT

A monorail bogie for supporting a monorail car travelling over a monorail track. The monorail bogie comprises a load-bearing wheel having an axis of rotation that is parallel to the running surface. The monorail bogie further comprises an inboard pair of guide wheels and an outboard pair of guide wheels. Each guide wheel of the inboard pair of guide wheels has an axis of rotation and each guide wheel of the outboard pair of guide wheels has an axis of rotation. The axes of rotation of the inboard pair of guide wheels and the axes of rotation of the outboard pair of guide wheels are offset in opposite directions in relation to the axis of rotation of the load bearing wheels. The monorail bogie further comprises at least one stabilizing wheel positioned co-axially with each one of the inboard pair of guide wheels.

23 Claims, 9 Drawing Sheets

FOREIGN PATENT DOCUMENTS

| | | |
|---|---|---|
| JP | 2000-071980 | 3/2000 |
| JP | 64078967 | 9/2000 |
| WO | PCT/CA2009/000161 | 5/2009 |
| WO | PCT/CA2009/000162 | 5/2009 |
| WO | PCT/CA2009/001487 | 7/2010 |

* cited by examiner

MONORAIL BOGIE HAVING IMPROVED ROLL BEHAVIOR

FIELD OF THE INVENTION

The present invention relates to the field of monorail bogies, and more specifically, to monorail bogies that include stabilizing wheels for improving roll behavior.

BACKGROUND OF THE INVENTION

Monorail bogies are known in the art, and are used in many monorail car assemblies. However, a common deficiency with monorail bogies, and particularly straddle beam monorail bogies, is that they have a tendency to roll from side-to-side when traveling on a monorail track, thus causing the monorail car to sway from side-to-side. This rolling motion can be concerning for passengers, and in some cases can even be dangerous.

In order to help prevent rolling effects, existing monorail bogies have included stabilizing wheels that are positioned centrally with respect to the upper guiding wheels, but are positioned lower on the monorail track than the upper guiding wheels. Unfortunately, this type of arrangement creates chording effects when the monorail car travels through curves in the track, which in turn causes undesirable bogie roll. More specifically, as the monorail car travels through curves in the track, the upper guide tires are positioned by the chord of the curvature while the lower stabilizing wheel is at the midpoint of the chord, thereby resulting in an offset and undesirable roll of the bogie.

FIG. 1 shows a top plan view of a prior art bogie arrangement, wherein the prior art bogie 4 includes four upper guide tires 6 and two lower guide tires 8. When the prior art bogie 4 travels on straight sections of track, all of the tires 6 and 8 are in alignment. However, when the prior art bogie 4 travels around a bend in a curve, the upper guide tires 6 are positioned on the outside of the chord, such that they can be joined by a straight line, whereas the lower guide tires 8 are positioned within the center of the chord. As such, the lower guide tires 8 are not in alignment with the four upper guide tires 4, which creates an offset. This offset creates an imbalance in the railcar, which results in roll about the track.

In light of the above, it can be seen that there is a need in the industry for an improved monorail bogie that alleviates, at least in part, the deficiencies of the prior art, and improves on the overall roll behavior of the monorail bogie particularly in curves or curve transitions.

SUMMARY OF THE INVENTION

In accordance with a first broad aspect, the present invention provides a monorail bogie for supporting a monorail car travelling over a monorail track that comprises a running surface, a first side surface and a second side surface. The monorail bogie comprises at least one load-bearing wheel for running along the running surface of the monorail track. The load-bearing wheels have an axis of rotation that is parallel to the running surface. The monorail bogie further comprises an inboard pair of guide wheels, wherein each guide wheel of the inboard pair of guide wheels is positioned to make contact with a respective one of the first and second side surfaces of the monorail track, and an outboard pair of guide wheels, wherein each guide wheel of the outboard pair of guide wheels is also positioned to make contact with a respective one of the first and second side surfaces of the monorail track. Each guide wheel of the inboard pair of guide wheels has an axis of rotation and each guide wheel of the outboard pair of guide wheels has an axis of rotation. The axes of rotation of the inboard pair of guide wheels being offset to one side of the axis of rotation of the load bearing wheels, and the axes of rotation of the outboard pair of guide wheels is offset to an opposite side of the axis of rotation of the at least one load bearing wheel. The monorail bogie further comprises at least one stabilizing wheel situated co-axially with each one of the inboard pair of guide wheels.

In accordance with a second broad aspect, the present invention provides a monorail car assembly for travelling over a monorail track that has a running surface, a first side surface and a second side surface. The monorail car assembly comprises a monorail car and at least one monorail bogie connected to the monorail car. The at least one monorail bogie comprises at least one load-bearing wheel for running along the running surface of the monorail track. The load-bearing wheels have an axis of rotation that is parallel to the running surface. The monorail bogie further comprises an inboard pair of guide wheels, wherein each guide wheel of the inboard pair of guide wheels is positioned to make contact with a respective one of the first and second side surfaces of the monorail track, and an outboard pair of guide wheels, wherein each guide wheel of the outboard pair of guide wheels is also positioned to make contact with a respective one of the first and second side surfaces of the monorail track. Each guide wheel of the inboard pair of guide wheels has an axis of rotation and each guide wheel of the outboard pair of guide wheels has an axis of rotation. The axes of rotation of the inboard pair of guide wheels being offset to one side of the axis of rotation of the load bearing wheels, and the axes of rotation of the outboard pair of guide wheels is offset to an opposite side of the axis of rotation of the at least one load bearing wheel. The monorail bogie further comprises at least one stabilizing wheel situated co-axially with each one of the inboard pair of guide wheels.

In accordance with a third broad aspect, the present invention provides a method for manufacturing a monorail bogie comprising providing a body portion suitable for supporting a monorail car over a monorail track that has a running surface, a first side surface and a second side surface. The method comprises mounting to the body portion of the monorail bogie at least one load-bearing wheel such that, when in operation, the load-bearing wheel has an axis of rotation that is parallel to the running surface of the monorail track. The method further comprises mounting to the body portion an inboard pair of guide wheels. Each guide wheel of the inboard pair of guide wheels is positioned to make contact with a respective one of the first and second side surfaces of the monorail track. The method further comprises mounting to the body portion an outboard pair of guide wheels. Each guide wheel of the outboard pair of guide wheels is positioned to make contact with a respective one of the first and second side surfaces of the monorail track, wherein each guide wheel of the inboard pair of guide wheels has an axis of rotation, and each guide wheel of the outboard pair of guide wheels has an axis of rotation. The axes of rotation of the inboard pair of guide wheels are offset to one side of the axis of rotation of the at least one load bearing wheel, and the axes of rotation of the outboard pair of guide wheels are offset to an opposite side of the axis of rotation of the at least one load bearing wheel. The method further comprises mounting at least one stabilizing wheel co-axially with each one of the inboard pair of guide wheels, such that the stabilizing wheels contact the first side surface and the second side surface respectively.

In accordance with a fourth broad aspect, the invention provides a method for mounting a pair of stabilizing wheels to a monorail bogie that travels over a monorail track that has a running surface, a first side surface and a second side surface. The monorail bogie comprises at least one load-bearing wheel for running along a monorail track, such that when in operation, the load-bearing wheel has an axis of rotation that is parallel to the running surface of the monorail track. The monorail bogie further comprises an inboard pair of guide wheels positioned to make contact with respective ones of the first and second side surfaces of the monorail track and an outboard pair of guide wheels that are also positioned to make contact with respective ones of the first and second side surfaces of the monorail track. Each guide wheel of the inboard pair of guide wheels has an axis of rotation, and each guide wheel of the outboard pair of guide wheels has an axis of rotation. The axes of rotation of the inboard pair of guide wheels are offset to one side of the axis of rotation of the at least one load bearing wheel, and the axes of rotation of the outboard pair of guide wheels are offset to an opposite side of the axis of rotation of the at least one load bearing wheel. The method comprises mounting to a body portion of the monorail bogie a first supporting arm and a second supporting arm, mounting to the first supporting arm a first stabilizing wheel such that the first stabilizing wheel is co-axial with a first one of the pair of inboard guide wheels, and mounting to the second supporting arm a second stabilizing wheel such that the second stabilizing wheel is co-axial with a second one of the pair of inboard guide wheels.

These and other aspects and features of the present invention will now become apparent to those of ordinary skill in the art upon review of the following description of specific embodiments of the invention and the accompanying drawings.

Other aspects and features of the present invention will become apparent to those ordinarily skilled in the art upon review of the following description of specific embodiments of the invention in conjunction with the accompanying figures.

DETAILED DESCRIPTION

Figure 2:
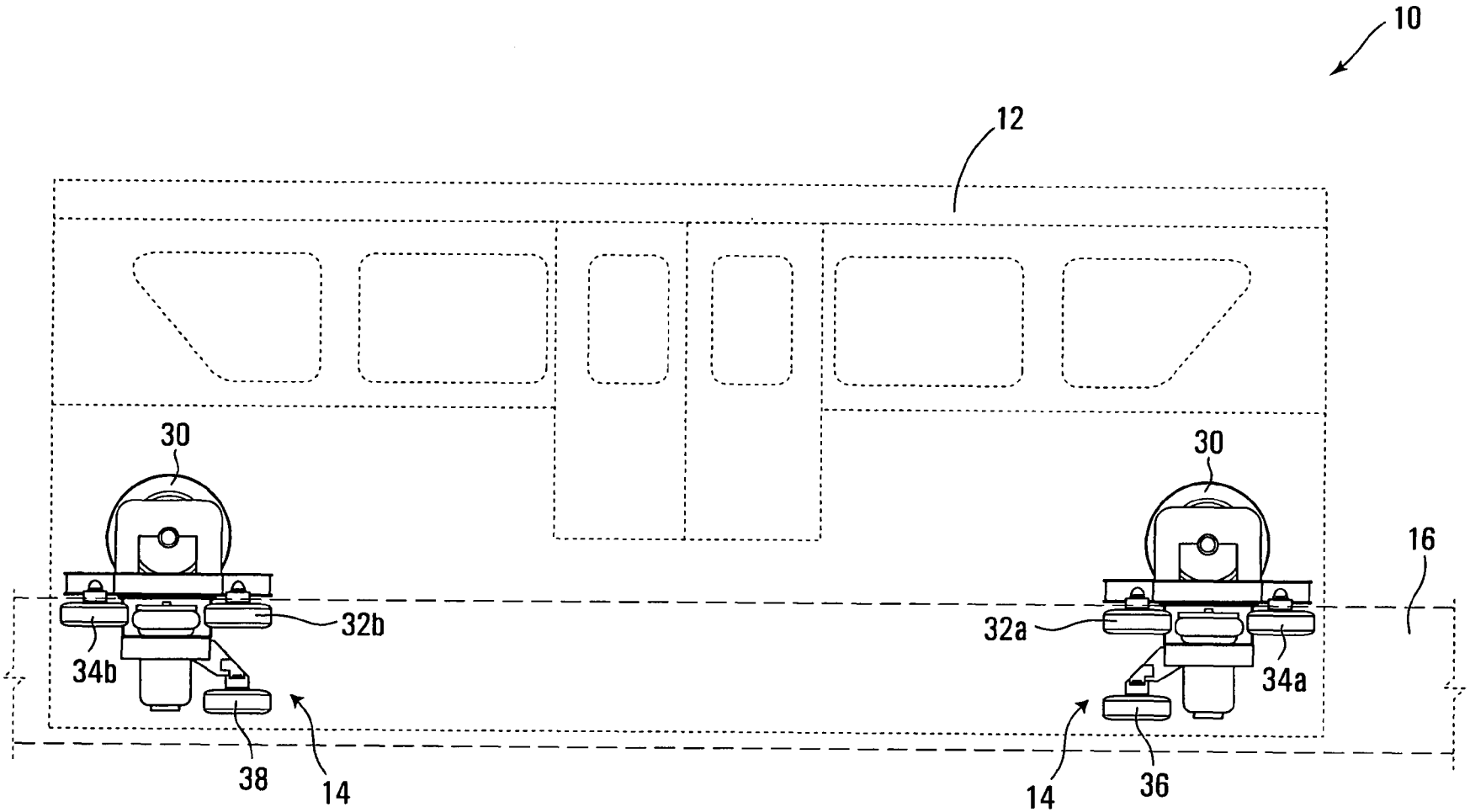
FIG. 2 shows a side view of a pair of monorail bogies in accordance with a non-limiting example of the present invention, for supporting a monorail car (shown in dotted lines) over a monorail track.

Turning now to the drawings and referring to FIG. 2, a non-limiting example of a monorail car assembly 10 that is suitable for travelling over a monorail track 16 is illustrated. The monorail car assembly 10 comprises a monorail car 12 and two single-axle bogies 14 that are operative for supporting the monorail car 12 over the monorail track 16. As will be described herein below, the monorail bogies 14 in accordance with the present invention are operative for reducing the rolling movement that is often experienced by monorail bogies, such that the bogies 14 sway minimally from side to side while travelling on the monorail track 16. This in turn reduces the rolling behaviour of the monorail cars 12 that are attached to the monorail bogies 14, which provides for a smoother, safer ride for passengers contained within the monorail car 12.

Although the monorail car 12 shown in FIG. 2 is a passenger car for carrying passengers, it should be appreciated that in an alternative embodiment, the monorail car 12 could also be a locomotive or a cargo car, without departing from the spirit of the invention. As such, the monorail bogies 14 described herein can be used for any type of rail car, such as passenger cars, locomotive cars, or cargo cars among other possibilities.

In addition, the monorail bogies that are shown in the Figures and that will be described in the present description are single-axle bogies 14. It should, however, be appreciated that the present invention is equally applicable to double axle bogies or multi-axle bogies. As such, the present invention is not limited to single-axle bogies.

Shown in FIGS. 3 through 6 is an expanded view of a single-axle bogie 14 in accordance with the present invention. The single-axle bogie 14 is shown positioned on a monorail track 16, and for the purposes of clarity, it is shown without the monorail car 12 attached thereto. The monorail track 16 along which the single-axle bogie 14 is designed to travel includes a substantially horizontal running surface 18 and two side surfaces 20. The monorail track 16 can be positioned along a ground-based guideway, or can be supported on elevated structures above the ground, such as in the case of an elevated transit system.

Figure 3:
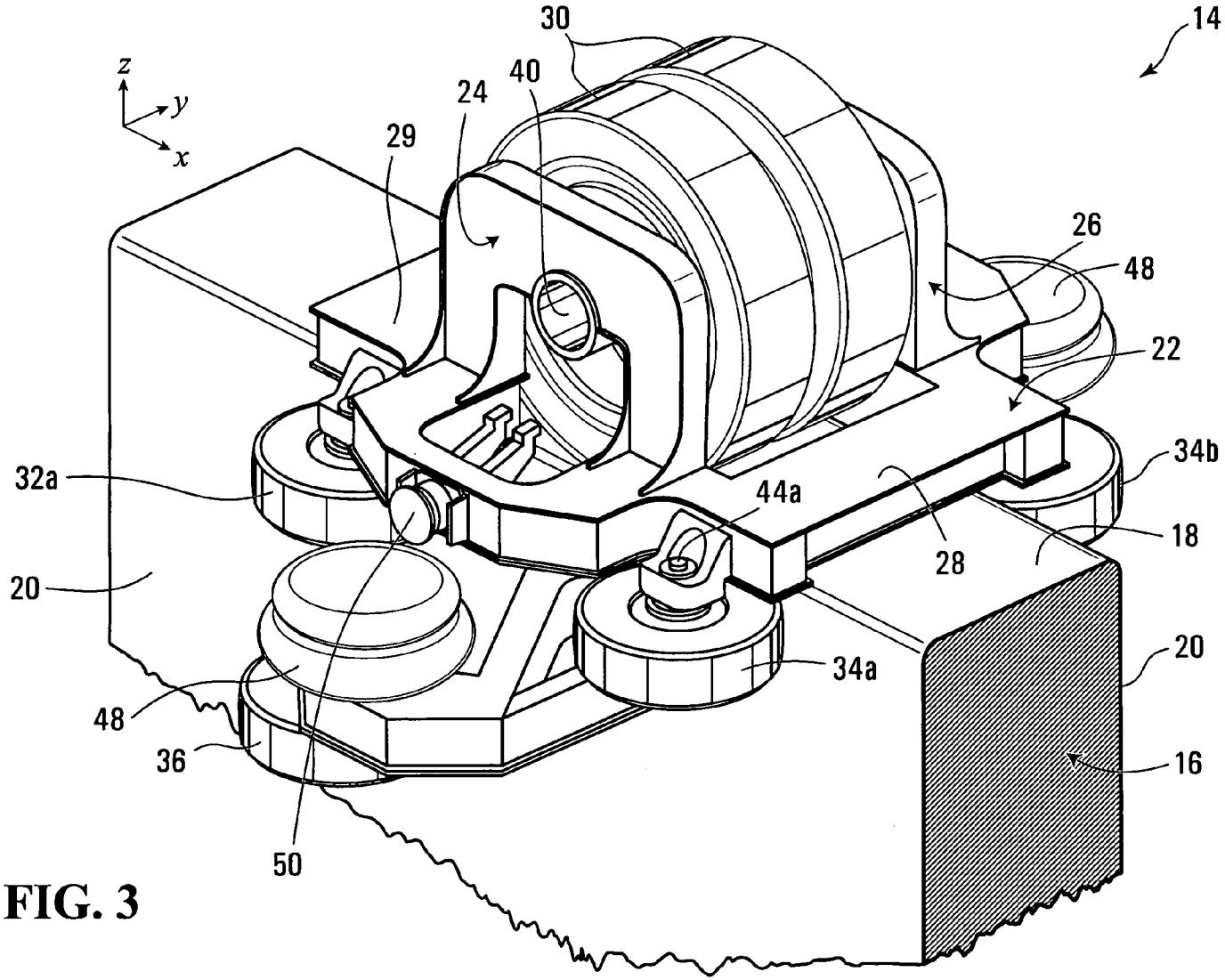
FIG. 3 shows a front perspective view of one of the monorail bogies of FIG. 2.

Shown in FIG. 3 is a three-dimensional Cartesian co-ordinate system that will be used as a reference for the purposes of the present description. As shown, the x-axis extends along the running surface 18 of the monorail track 16. In addition, the y-axis extends from side-to-side along the running surface 18, and the z-direction extends above and below the running surface 18 of the monorail track 16 such that it is perpendicular to the running surface 18.

As best shown in FIG. 3, the monorail bogie 14 includes a body portion 22 that has a first side portion 24 and a second side portion 26 that are joined together by a front joining portion 28 and a rear joining portion 29. The body portion 22 of the single-axle bogie 14 can be made of steel, or a steel alloy, among other possibilities. It should be appreciated that the single-axle bogie 14 can be made of a variety of different materials, so long as they provide the desired strength and rigidity characteristics for the intended application.

When the single-axle bogie 14 is positioned on the monorail track 16, the front-joining portion 28 and the rear-joining portion 29 extend over the running surface 18 of the monorail track 16. In addition, the first side portion 24 and the second side portion 26 are positioned such that they are adjacent respective ones of the two side surfaces 20 of the monorail track 16. In the embodiment shown, the front-joining portion 28 and the rear-joining portion 29 are in the form of rectangular shaped beams. It should, however, be appreciated that the front-joining portion 28 and the rear-joining portion 29 could be of any shape, size and configuration that is suitable for joining the first side portion 24 and the second side portion 26 of the single-axle bogie 14 together. In addition, the front-joining portion 28 and the rear-joining portion 29 are not necessarily required to be facing frontwardly or rearwardly when the single-axle bogie 14 is attached to the monorail car 12. Instead, the front-joining portion 28 and the rear-joining portion 29 can be positioned in either direction of travel, such that the single-axle bogie 14 can travel in either direction regardless of its orientation on the track 16.

Figure 5:
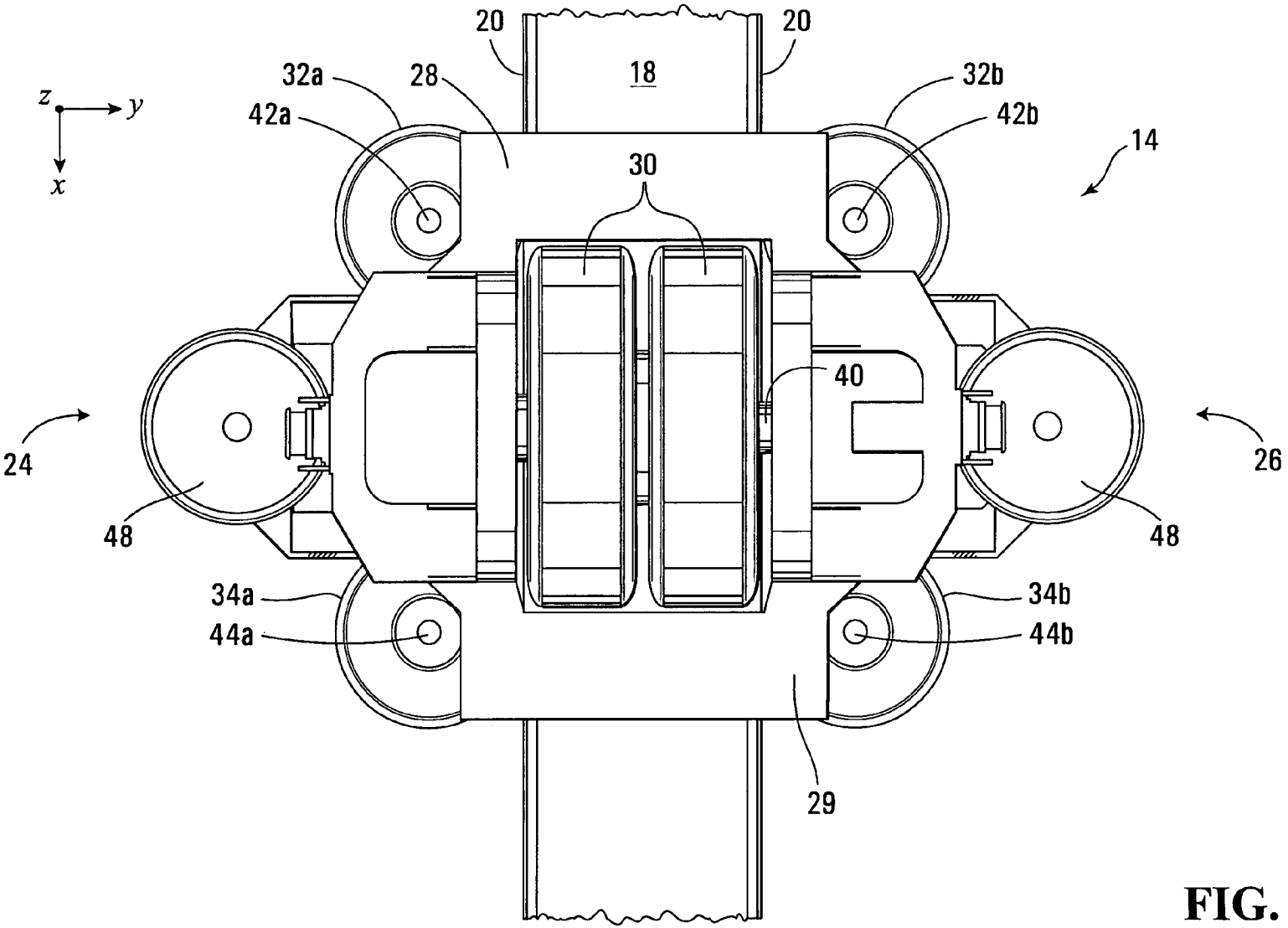
FIG. 5 shows a top view of the monorail bogie of FIG. 3.
Figure 6:
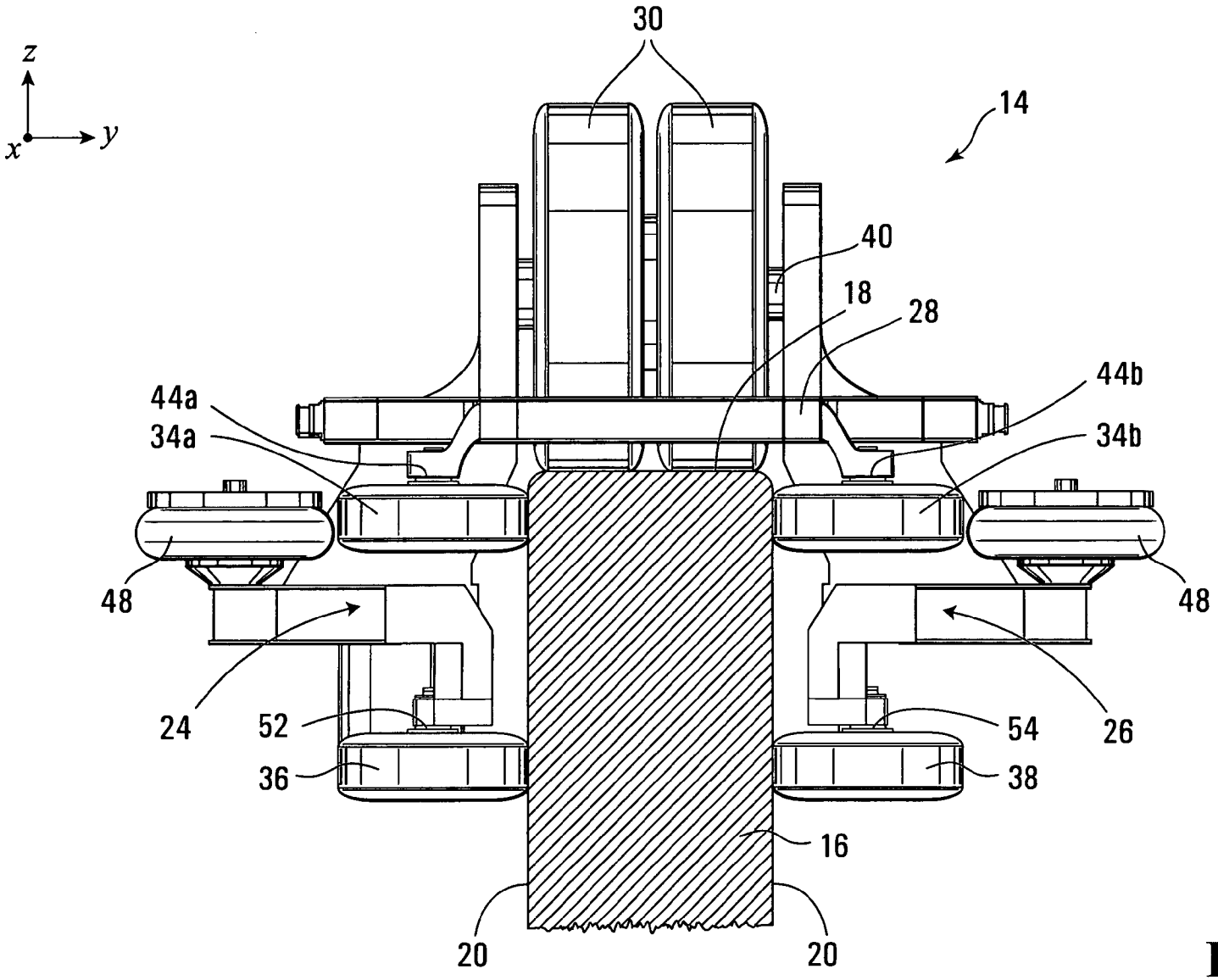
FIG. 6 shows a rear plan view of the monorail bogie of FIG. 3.

In the embodiment shown, the body portion 22 of the single-axle bogie 14 is operative for supporting two load bearing wheels 30, a first pair of guide wheels 32*a* and 32*b* and a second pair of guide wheels 34*a* and 34*b* (shown in FIG. 5) as well as two stabilizing wheels 36 and 38 (shown in FIG. 6). The first pair of guide wheels 32*a* and 32*b* are inboard guide wheels, and are positioned such that they contact the first and second sides 20 of the monorail track respectively. As used herein, the "inboard guide wheels" are the guide wheels that are positioned on the end of the bogie 14 that is closer to the centre of the monorail car. The second pair of guide wheels 34*a* and 34*b* are outboard guide wheels, and are positioned such that they contact the first and second sides of the monorail track respectively. As used herein, the "outboard guide wheels" are the guide wheels that are positioned on the end of the bogie that is closer to the end of the monorail car. As shown, the monorail bogie 14 also includes a pair of stabilizing wheels 36 and 38 that are positioned below, and co-axial with, the inboard guide wheels 32*a* and 32*b*. FIG. 2 provides a good visualization of the stabilizing wheels positioned beneath the inboard guide wheels 32*a* and 32*b*.

The load-bearing wheels 30, guide wheels 32*a*, 32*b*, 34*a* and 34 and stablizing wheels 36, 38 are generally made of rubber, however, they can also be pneumatic tires, semi-pneumatic tires, solid rubber tires, plastic tires, metal wheels or any other type of tire or wheel known in the art. The load-bearing wheels 30 generally have a diameter of between 6 inches and 30 inches (however, smaller or larger diameter tires or wheels may be used depending on the required application). The guide wheels 32*a*, 32*b*, 34*a* and 34*b* and stabilizing wheels 36, 38 also generally have a diameter of between 6 inches and 30 inches (however, smaller or larger diameter tires may be used depending on the required application). Typically, the load bearing wheels 30 tend to be of greater dimension when compared with the dimension of the stabilizing and guide wheels 32*a*, 32*b*, 34*a*, 34*b*, 36 and 38. Further, to aid with interchangeability between the stabilizing wheels and the guide wheels, their diameters and points of affixation are kept identical. In the embodied arrangement, the stabilizing wheels 36 and 38 are co-axial with the guide wheels 32*a* and 32*b*. However, as will be appreciated by a person skilled in the art, deviations of the positioning of the stabilizing wheels 36 and 38 with respect to the guide wheels 32*a* and 32*b* is possible.

As shown in FIG. 3, the single-axle bogie 14 is further operative for supporting a suspension system 48 that is positioned between the single-axle bogie 14 and the monorail car 12. The suspension system 48 helps to prevent bumps and shocks experienced by the single-axle bogie 14 from being transferred to the monorail car 12. In the embodiment shown, the suspension system 48 comprises two bell suspension devices that are positioned on either side of the single-axle bogie 14. It should, however, be appreciated that any suitable suspension system known in the art could be used without departing from the spirit of the invention.

With reference to FIG. 5, it can be seen that the two load-bearing wheels 30 are positioned between the front joining portion 28 and the rear joining portion 29 of the body portion 22 of the single-axle bogie 14. The two load-bearing wheels 30 are operative for running along the horizontal running surface 18 of the monorail track 16. The axle 40 of the two load-bearing wheels is supported on either side by the first side portion 24 and the second side portion 26 of the body portion 22 of the single-axle bogie 14 such that the axis of rotation about which the two load-bearing wheels 30 rotate is parallel to the running surface 18 of the monorail track 16. In the embodiment shown, the single-axis bogie 14 includes two load-bearing wheels 30. It should, however, be appreciated that the single-axle bogie 14 could include only one load-bearing wheel, or three or more load-bearing wheels 30, without departing from the spirit of the invention.

In accordance with a non-limiting example of implementation, the body portion 22 of the single axle bogie 14 is symmetric about either side of the axle 40 of the load bearing wheels 30 (with the exception of the supporting arms 56, which will be described in more detail below). This provides balanced bi-directional operation, such that the single-axle bogie 14 can equally move either forwards or backwards with minimal change in balance. The suspension system 48 is also positioned centrally with respect to the axle 40 of the load-bearing wheels. It should be understood that this invention does not preclude other non-symmetric implementations depending on the application requirements.

The propulsion and braking components of the bogie are not illustrated and described for greater clarity of the recited invention. Any suitable propulsion system (AC or DC), including the use of a hub-based motor may be used for providing propulsion. Similarly, any known braking system can be included for the purpose of providing the braking function. Obviously, the inclusion of different and known systems will require modifications to the bogie 14 to accommodate the inclusion and necessitation of the desired functions. Such modifications are considered to be within the scope of the present invention and the invention does not limit itself to providing these functions.

With reference to FIG. 5, the first pair of guide wheels 32*a* and 32*b* (namely the inboard guide wheels) each include an axle 42*a* and 42*b* respectively. Axles 42*a* and 42*b* have axes of rotation that are laterally offset (in the x-direction) to one side of the axis of rotation of the load bearing wheels 30. Similarly, the second pair of guide wheels 34*a* and 34*b* (namely the outboard guide wheels) each include an axle 44*a* and 44*b* respectively. Axles 44*a* and 44*b* have axes of rotation that are laterally offset (in the x-direction) to the opposite side of the axis of rotation of the load bearing wheels 30. Axles 42*a*, 42*b*, 44*a* and 44*b* are operative for being substantially parallel to the two side surfaces 20 of the monorail track 16 when in operation.

In accordance with a non-limiting example of implementation, the first pair of guide wheels 32*a* and 32*b* and the second pair of guide wheels 34*a* and 34*b* are positioned such that the axle 40 of the load-bearing wheels 30 is positioned centrally between the first pair of guide wheels 32*a*, 32*b* and the second pair of guide wheels 34*a*, 34*b*. More specifically, the axis of rotation 40 is equidistant in the x direction from the axles 42*a*, 42*b* and from the axles 44*a* and 44*b*. In an alternative embodiment, the axle of the load-bearing wheels 30 may not be equidistant between the first set of guide wheels 32*a*, 32*b* and the second set of guide wheels 34*a*, 34*b*, and instead may be positioned more towards the first set of guide wheels 32*a*, 32*b* than the second set of guide wheels 34*a*, 34*b*, or vice versa.

Figure 4:
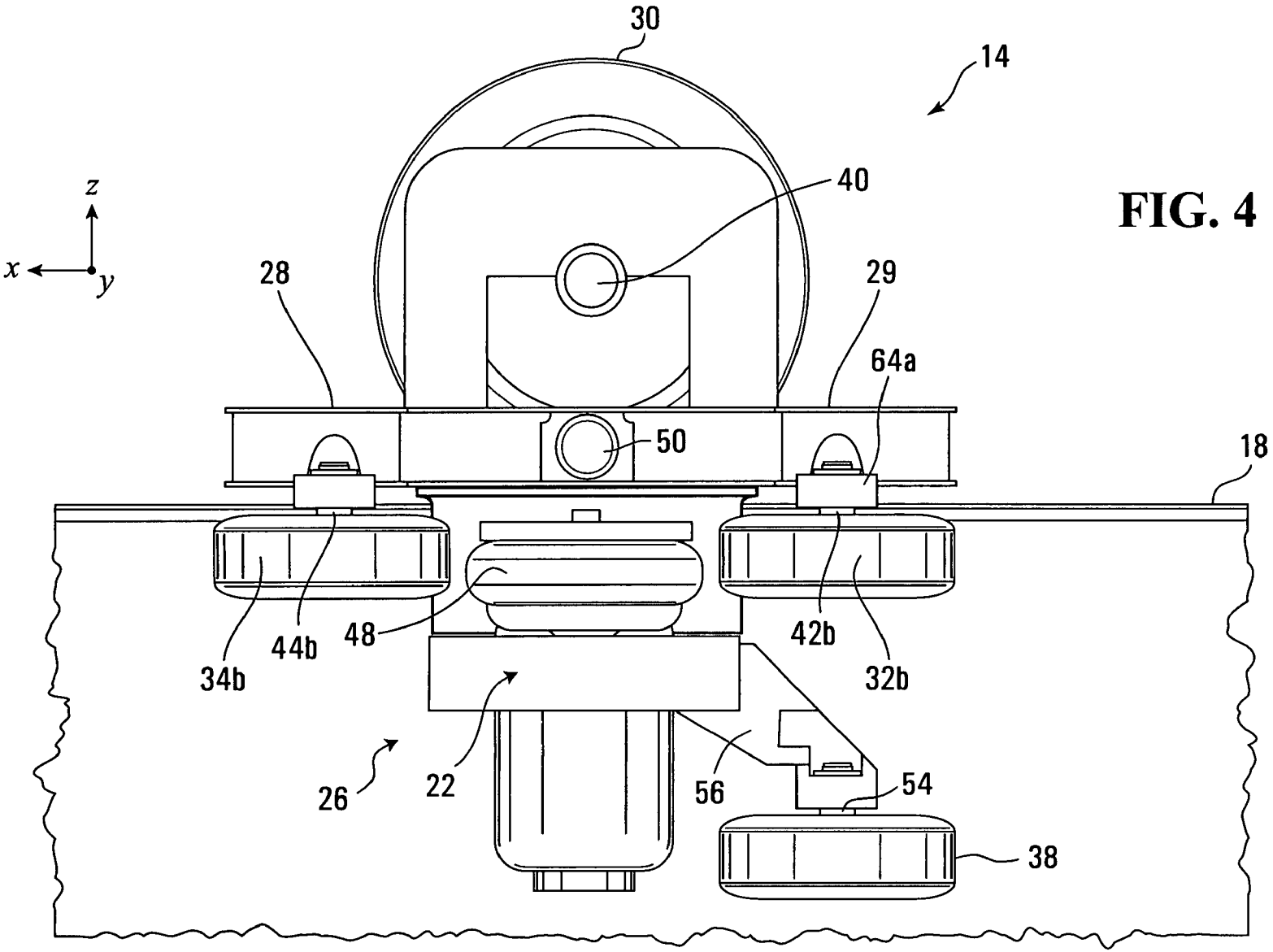
FIG. 4 shows a side view of the monorail bogie of FIG. 3.

As shown in FIG. 4, positioned below the guide wheel 32*b* of the first pair of guide wheels is a stabilizing wheel 38, and although not shown, positioned below the guide wheel 32*b* of the first pair of guide wheels is a stabilizing wheel 36. Preferably, the stabilizing wheel 36 has an axle 54 that is co-axial with the axle 42*a* of the guide wheel 32*a* and the stabilizing wheel 38 has an axle 52 that is co-axial with the axle 42*b* of the guide wheel 32*b*. The stabilizing wheels 36 and 38 are positioned beneath the respective guide wheels 32*b* and 32*b* in the z-direction, such that they are positioned beneath the inboard guide wheels. In accordance with a non-limiting embodiment, the stabilizing wheels 36 and 38 are positioned a distance of between 12 inches and 60 inches (in the z direction) away from guide wheels 32*a* and 32*b*, respectively. It should, however, be appreciated that this distance may vary depending on different constructions and applications of the bogie 14. Furthermore, as described earlier, the guide wheels 32*a* and 32*b* need not be co-axial with stabilizing wheels 36 and 38 respectively.

Referring back to FIG. 4, the stabilizing wheel 38 is supported beneath the guide wheel 32*b* by a supporting arm 56. In the non-limiting embodiment shown, the supporting arm 56 extends from the body portion 22 of the single-axle bogie 14 at a downward angle, such that it is positioned at an angle in relation to the axle 54 of the stabilizing wheel 38. It should be appreciated that in an alternative embodiment, the stabilizing wheel 38 could be supported by the single axle bogie 14 in a variety of different manners, other than arm 56. So long as the stabilizing wheel 38 is secured to the single-axle bogie 14 such that axle 54 is positioned directly beneath, and co-axial with, the axle 42*b* of the guide wheel 32*b*, then the stabilizing wheel 38 can be mounted to the single axle bogie 14 in any manner known in the art. Although the supporting arm 56 has been described with respect to stabilizing wheel 38, it should be understood that the stabilizing wheel 36 (which cannot be seen in FIG. 4) is also secured to the single axle bogie 14 in the same manner as stabilizing wheel 38. Yet another non-limiting aspect of the present invention is that the arm 56 may be formed of single or multiple parts.

By positioning the stabilizing wheels 36 and 38 beneath the guide-wheels 32*a* and 32*b* in the z-direction, the stabilizing wheels 36 and 38 act to prevent the rolling of the single-axle bogie 14 about the monorail track 16, which in turn reduces the rolling of the monorail car 12. More specifically, by having the stabilizing wheels 36 and 38 positioned directly beneath respective guide wheels 32*a* and 32*b*, the axles of the guide wheels and the stabilizing wheels remain substantially parallel to the side surfaces 20 of the monorail track 16 during travel.

Figure 1:
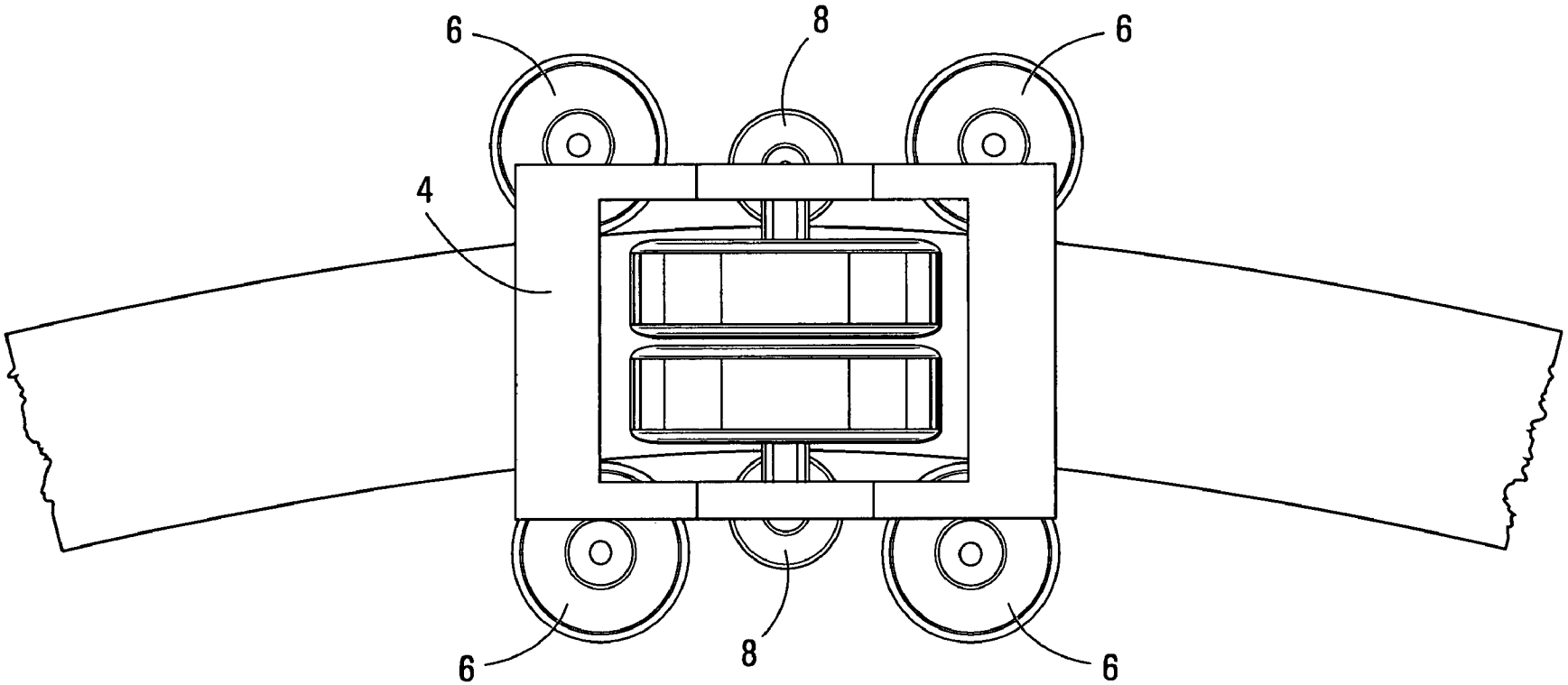
FIG. 1 Prior Art
FIG. 1 shows a top plan view of a prior art monorail bogie having four upper guide tires and two lower guide tires.

In addition, by positioning the stabilizing wheels 36, 38 directly below, and co-axial with, the guide wheels 32*a* and 32*b*, chording effects that occur when the monorail car assembly 10 travels around bends are reduced. In previous designs (such as that shown in FIG. 1) where the stabilizing wheels were positioned between the guide wheels, when the monorail track curved, not all three of the wheels could be positioned on the chord of the curve at the same time, thus leading to an offset and undesirable roll of the bogie. In dual axle bogies, badly positioned stabilizing wheels can cause misalignment of the axle of the load-bearing wheels as well.

In contrast, the positioning of the guide wheels 32*a*, 32*b*, 34*a* and 34*b* and stabilizing wheels 36, 38 of the present invention allow the guide wheels 32*a*, 32*b*, 34*a* and 34*b*, as well as the stabilizing wheels 36 and 38, to follow the curvature of the monorail track during travel without creating any unwanted rolling effects. In addition, the fact that there is no guide wheel or stabilizing wheel positioned centrally with respect to the load-bearing wheels 30 enables stable operation and optimum alignment of the load-bearing wheels with the direction of travel. In other words, it permits the axle 40 of the load-bearing wheels 30 to be aligned radially with the curvature of the track 16 at all times.

As best shown in FIGS. 3 and 4, the stabilizing wheels 36 and 38 are positioned beneath the "inboard" guide wheels 32*a* and 32*b* of the single axle bogie 14. When the single-axle bogie 14 is mounted to the monorail car 12, the stabilizing wheels 36, 38 are positioned on the inboard side of the load-bearing wheels 30. The inboard side of the load-bearing wheels 30 is the side that is closest to the centre of the railcar and the outboard side of the load-bearing wheels 30 is the side that is closest to the end of the railcar. It should, however, be appreciated that the stabilizing wheels 36, 38 could also be positioned beneath the "outboard" guide wheels 34*a* and 34*b* of the single axle bogie 14 without departing from the spirit of the invention.

Although not shown in the Figures, in a non-limiting embodiment of the present invention, the single-axle bogie 14 can further include mechanisms for providing enhancement to non-roll characteristics of the monorail bogie, such as for providing pitching or torsion control.

Figure 8:
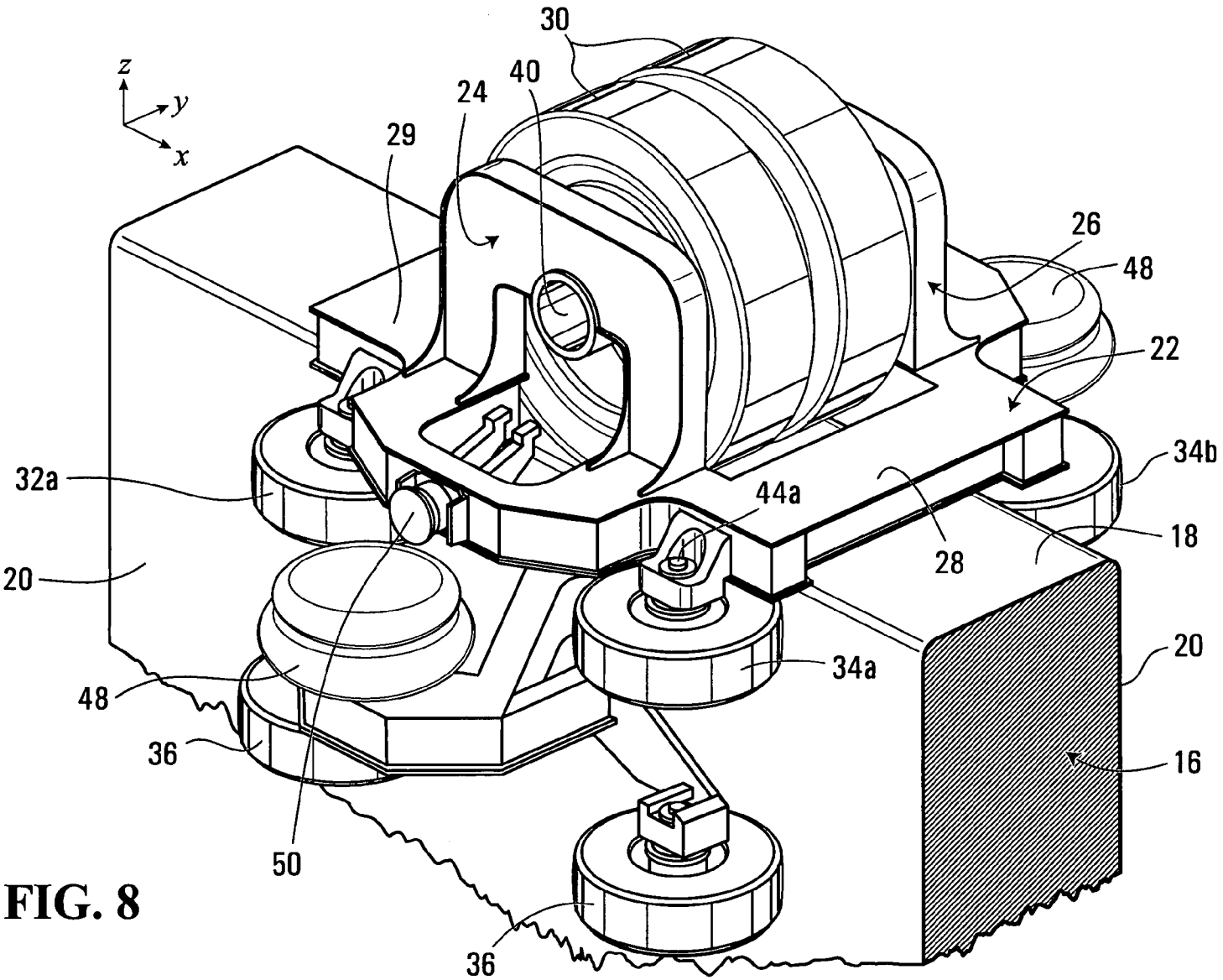
FIG. 8 shows a front perspective view of a monorail bogie in accordance with a third non-limiting example of implementation of the present invention, wherein the monorail bogie includes four stabilizing wheels.
Figure 9:
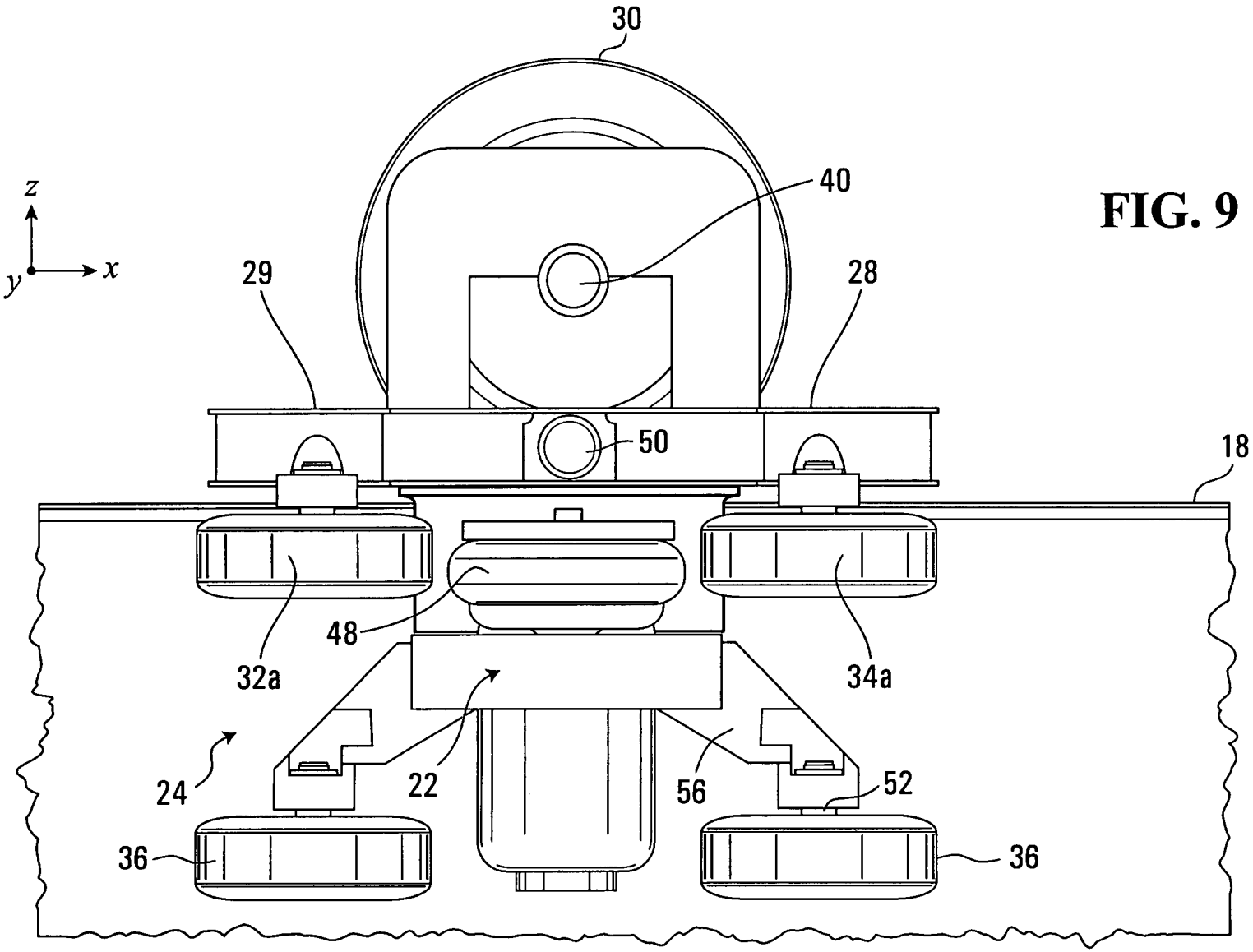
FIG. 9 shows a side view of the monorail bogie of FIG. 8.

In accordance with a further non-limiting embodiment of the present invention, as illustrated in FIGS. 8 and 9, the single-axle bogie 14 can include four stabilizing wheels, such that two stabilizing wheels 36 are located on one side of the monorail track 16 and two stabilizing wheels 38 are located on the other side of the monorail track 16. This means that there is a stabilizing wheel beneath each of the four guide wheels 32*a*, 32*b*, 34*a* and 34*b* respectively. In this manner, the single-axle bogie 14 has four wheels travelling along each side surface 20 of the monorail track. By including four wheels per side of the single axle bogie 14, the roll stiffness is increased, thus helping to further mitigate the effects of roll-induced steering.

Each of the stabilizing wheels 36 is positioned beneath, and co-axial with, the respective guide wheels 32*a* and 34*a* and each of the stabilizing wheels 38 is positioned beneath, and co-axial with, the respective guide wheels 32*b*, and 34*b* in the z-direction.

An exemplary method of assembling a monorail bogie in accordance with the present invention is described below with reference to the flow chart in FIG. 7. Firstly, at step 70, the method involves providing a body portion (such as body portion 22) that is suitable for supporting a monorail car over the monorail track 16. At step 72, the method comprises mounting to the body portion 22 of the monorail bogie 14 at least one load-bearing wheel 30 such that the load-bearing wheel has an axis of rotation 40 that is parallel to the running surface 18 of the monorail track. As described above the load bearing wheel(s) 30 can be supported by the first and second side portions 24, 26 of the body portion 22.

At step 74 the method further comprises mounting to the body portion an inboard pair of guide wheels 32*a*, 32*b*, such that each guide wheel of the inboard pair of guide wheels 32*a*, 32*b* is positioned to make contact with a respective one of the first and second side surfaces 20 of the monorail track 16, and at step 76 mounting to the body portion 22 an outboard pair of guide wheels 34*a*, 34*b* such that each guide wheel of the outboard pair of guide wheels 34*a*, 34*b* is also positioned to make contact with a respective one of the first and second side surfaces 20 of the monorail track 16. Each guide wheel of the inboard pair of guide wheels 32*a*, 32*b* has an axis of rotation 42*a*, 42*b* respectively, and each guide wheel of the outboard pair of guide wheels 34*a*, 34*b* has an axis of rotation 44*a*, 44*b* respectively. The axes of rotation 42*a*, 42*b* of the inboard pair of guide wheels 32*a*, 32*b* being offset to one side of the axis of rotation 40 of the load bearing wheel(s) 30, and the axes of rotation 44*a*, 44*b* of the outboard pair of guide wheels 34*a*, 34*b* being offset to an opposite side of the axis of rotation of the load bearing wheel(s) 30. Finally, at step 78, the method involves mounting at least one stabilizing wheel 36, 38 co-axially with each one of said inboard pair of guide wheels 32*a*, 32*b*, such that the stabilizing wheels 36, 38 contact the first and second side surfaces 20 respectively.

Figure 7:
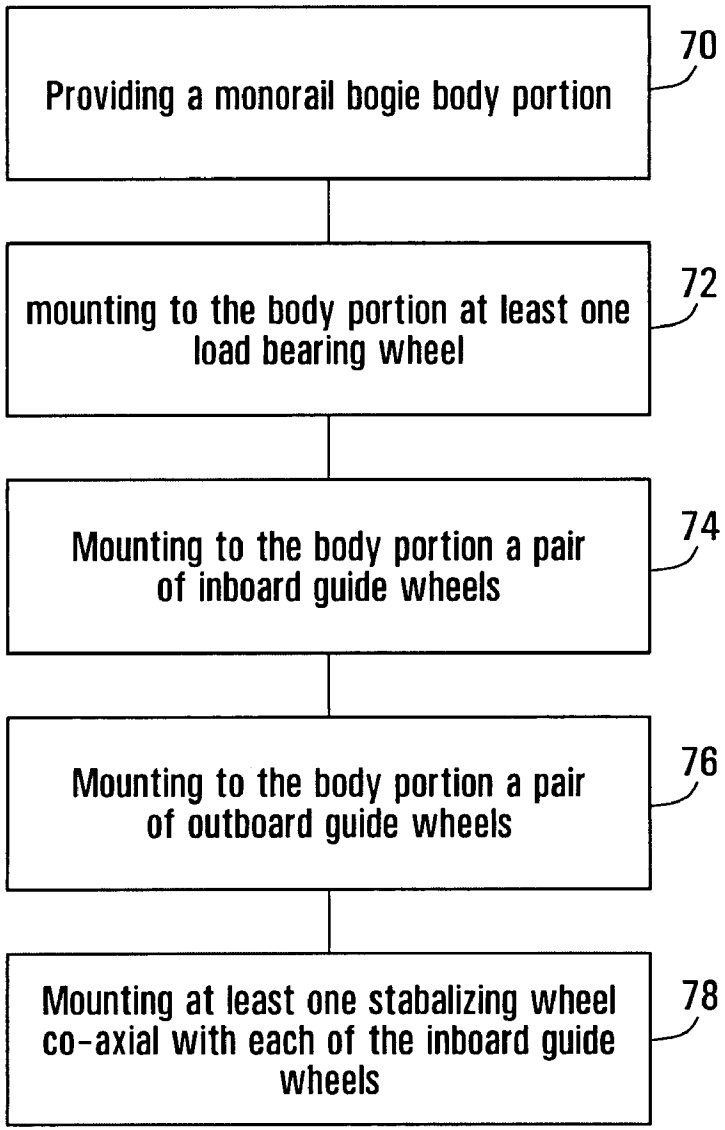
FIG. 7 shows a non-limiting example of a flow diagram of a method for manufacturing a monorail bogie in accordance with the present invention.

In accordance with an optional embodiment not shown in the flow chart of FIG. 7, the method further comprises providing two additional stabilizing wheels such that they are co-axial with the respective ones of the second pair of guide wheels 34*a* and 34*b*. As such, the monorail bogie 14 manufactured according to this additional step will include a total of at least four stabilizing wheels, as shown in FIGS. 8 and 9.

Furthermore, an exemplary method of retrofitting an existing monorail bogie with stabilizing wheels in order to reduce rolling effects will be described below. The monorail bogie to be retrofitted with stabilizing wheels will comprise at least one load-bearing wheel for running along a monorail track, such that when in operation, the load-bearing wheel has an axis of rotation that is parallel to the running surface of the monorail track. The monorail bogie will further comprise an inboard pair of guide wheels positioned to make contact with respective ones of the first and second side surfaces of the monorail track and an outboard pair of guide wheels positioned to make contact with respective ones of the first and second side surfaces of the monorail track. Each guide wheel of the inboard pair of guide wheels has an axis of rotation, and each guide wheel of the outboard pair of guide wheels has an axis of rotation. The axes of rotation of the inboard pair of guide wheels are offset to one side of the axis of rotation of the at least one load bearing wheel, and the axes of rotation of the outboard pair of guide wheels are offset to an opposite side of the axis of rotation of the at least one load bearing wheel. The method of retrofitting comprises mounting to a body portion of the existing monorail bogie a first supporting arm and a second supporting arm, mounting to the first supporting arm a first stabilizing wheel such that the first stabilizing wheel is co-axial with one of the pair of inboard guide wheels and mounting to the second supporting arm a second stabilizing wheel such that the second stabilizing wheel is co-axial with the other one of the pair of inboard guide wheels.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A monorail bogie for supporting a monorail car travelling over a monorail track, the monorail track having a running surface, a first side surface and a second side surface, said monorail bogie comprising:

a body portion having a front portion and a rear portion;

at least one load-bearing wheel for running along the running surface of the monorail track, the at least one load-bearing wheel being positioned substantially centrally between said front portion and said rear portion;

an inboard pair of guide wheels located in proximity to said front portion of said body portion, each guide wheel of said inboard pair of guide wheels being positioned to make contact with a respective one of the first and second side surfaces of the monorail track;

an outboard pair of guide wheels located in proximity to said rear portion of said body portion, each guide wheel of said outboard pair of guide wheels being positioned to make contact with a respective one of the first and second side surfaces of the monorail track;

at least one stabilizing wheel situated co-axially with each one of said inboard pair of guide wheels.

2. A monorail bogie as defined in claim 1, wherein said monorail bogie is one of a single-axle bogie, a double axle bogie and a multi-axle bogie.

3. A monorail bogie as defined in claim 2, wherein said inboard pair of guide wheels are positioned symmetrically on said monorail bogie.

4. A monorail bogie as defined in claim 2, further comprising at least one stabilizing wheel positioned below each one of said outboard pair of guide wheels.

5. A monorail bogie as defined in claim 2, wherein said at least one stabilizing wheel is supported by an arm portion that extends from a body portion of said monorail bogie.

6. A monorail bogie as defined in claim 1, wherein said at least one load-bearing wheel comprises an axis of rotation, each wheel of said inboard pair of guide wheels comprises an axis of rotation and each wheel of said outboard pair of guide wheels comprises an axis of rotation, said axes of rotation of said inboard pair of guide wheels and said axes of rotation of said outboard pair of guide wheels are positioned equidistant from said axis of rotation of said load-bearing wheel.

7. A monorail bogie as defined in claim 1, wherein at least a portion of said monorail bogie is formed from steel.

8. A monorail car assembly for travelling over a monorail track, the monorail track having a running surface, a first side surface and a second side surface, said monorail car assembly comprising:

a monorail car; and at least one monorail bogie connected to said monorail car, the monorail bogie comprising a body portion having a front portion and a rear portion, said at least one monorail bogie comprising:

i) at least one load-bearing wheel for running along the running surface of the monorail track, the at least one load-bearing wheel being positioned substantially centrally between said front portion and said rear portion and having an axis of rotation that is parallel to the running surface;

ii) an inboard pair of guide wheels, each guide wheel of said inboard pair of guide wheels being positioned to make contact with a respective one of the first and second side surfaces of the monorail track;

iii) an outboard pair of guide wheels, each guide wheel of said outboard pair of guide wheels being positioned to make contact with a respective one of the first and second side surfaces of the monorail track, each guide wheel of said inboard pair of guide wheels having an axis of rotation and each guide wheel of said outboard pair of guide wheels having an axis of rotation, the axes of rotation of said inboard pair of guide wheels being offset to one side of said axis of rotation of said at least one load bearing wheel, and said axes of rotation of said outboard pair of guide wheels being offset to an opposite side of said axis of rotation of said at least one load bearing wheel; and iv) at least one stabilizing wheel situated co-axially with each one of said inboard pair of guide wheels.

9. A monorail car assembly as defined in claim 8, wherein said monorail bogie is one of a single-axle bogie, a double axle bogie and a multi-axle bogie.

10. A monorail car assembly as defined in claim 8, wherein said inboard pair of guide wheels are positioned symmetrically on said monorail bogie.

11. A monorail car assembly as defined in claim 8, further comprising at least one stabilizing wheel positioned below each one of said outboard pair of guide wheels.

12. A monorail car assembly as defined in claim 8, wherein said at least one stabilizing wheel is supported by an arm portion that extends from a body portion of said monorail bogie.

13. A monorail car assembly as defined in claim 8, wherein said axes of rotation of said inboard pair of guide wheels and said axes of rotation of said outboard pair of guide wheels are positioned equidistant from said axis of rotation of said load bearing wheel.

14. A monorail car assembly as defined in claim 13, wherein at least a portion of said monorail bogie is formed from steel.

15. A method for manufacturing a monorail bogie comprising:

providing a body portion suitable for supporting a monorail car over a monorail track, the body portion having a front portion and a rear portion, the monorail track having a running surface, a first side surface and a second side surface;

mounting to the body portion of the monorail bogie at least one load-bearing wheel such that, when in operation, said load-bearing wheel is positioned substantially centrally between the front portion and the rear portion and has an axis of rotation that is parallel to the running surface of the monorail track;

mounting to the body portion an inboard pair of guide wheels, each guide wheel of the inboard pair of guide wheels being positioned to make contact with a respective one of the first and second side surfaces of the monorail track; and mounting to the body portion an outboard pair of guide wheels, each guide wheel of the outboard pair of guide wheels being positioned to make contact with a respective one of the first and second side surfaces of the monorail track, wherein each guide wheel of the inboard pair of guide wheels has an axis of rotation, and each guide wheel of the outboard pair of guide wheels has an axis of rotation, the axes of rotation of the inboard pair of guide wheels being offset to one side of the axis of rotation of the at least one load bearing wheel, and the axes of rotation of the outboard pair of guide wheels being offset to an opposite side of the axis of rotation of the at least one load bearing wheel;

mounting at least one stabilizing wheel co-axially with each one of said inboard pair of guide wheels, the stabilizing wheels contacting the first side surface and the second side surface respectively.

16. A method as defined in claim 15, wherein the monorail bogie is one of a single-axle bogie, a double axle bogie and a multi-axle bogie.

17. A method as defined in claim 15, wherein said inboard pair of guide wheels are adapted for being positioned symmetrically on either side of the monorail track.

18. A method as defined in claim 15, further comprising mounting to the monorail bogie at least one stabilizing wheel below each one of said outboard pair of guide wheels.

19. A method as defined in claim 15, wherein each stabilizing wheel is supported by an arm portion that extends from a body portion of the monorail bogie.

20. A method as defined in claim 15, wherein the inboard pair of guide wheels and the outboard pair of guide wheels are mounted to the monorail bogie such that the axes of rotation of the inboard pair of guide wheels and the axes of rotation of the outboard pair of guide wheels are positioned equidistant from the axis of rotation of the load bearing wheel.

21. A method for mounting a pair of stabilizing wheels to a monorail bogie for travelling over a monorail track, the monorail track having a running surface, a first side surface and a second side surface, the monorail bogie comprising a front portion and a rear portion at least one load-bearing wheel for running along a monorail track, such that when in operation, the load-bearing wheel is positioned substantially centrally between the front portion and the rear portion and has an axis of rotation that is parallel to the running surface of the monorail track, the monorail bogie further comprising an inboard pair of guide wheels positioned to make contact with respective ones of the first and second side surfaces of the monorail track and an outboard pair of guide wheels positioned to make contact with respective ones of the first and second side surfaces of the monorail track, wherein each guide wheel of the inboard pair of guide wheels has an axis of rotation, and each guide wheel of the outboard pair of guide wheels has an axis of rotation, the axes of rotation of the inboard pair of guide wheels being offset to one side of the axis of rotation of the at least one load bearing wheel, and the axes of rotation of the outboard pair of guide wheels being offset to an opposite side of the axis of rotation of the at least one load bearing wheel, said method comprising:

mounting to a body portion of the monorail bogie a first supporting arm and a second supporting arm;

mounting to the first supporting arm a first stabilizing wheel such that the first stabilizing wheel is co-axial with a first one of the pair of inboard guide wheels; and mounting to the second supporting arm a second stabilizing wheel such that the second stabilizing wheel is co-axial with a second one of the pair of inboard guide wheels.

22. A method as defined in claim 21, further comprising:

mounting to a body portion of the monorail bogie a third supporting arm and a fourth supporting arm;

mounting to the third supporting arm a third stabilizing wheel such that the third stabilizing wheel has an axis of rotation that is co-axial with the a first one of the pair of outboard guide wheels; and mounting to the fourth supporting arm a fourth stabilizing wheel such that the fourth stabilizing wheel has an axis of rotation that is co-axial with the a second one of the pair of outboard guide wheels.

23. A monorail bogie as defined in claim 1, wherein said body portion is positioned beneath a single monorail car.

* * * * *